United States Patent [19]

Taylor et al.

[11] Patent Number: 4,522,154

[45] Date of Patent: Jun. 11, 1985

[54] FLUIDIZED BED COMBUSTION BOILER

[75] Inventors: Edward S. Taylor, Del Mar, Calif.; Leif W. Bengtsson, Helsinki, Finland

[73] Assignee: Pyropower Corporation, San Diego, Calif.

[21] Appl. No.: 578,068

[22] Filed: Feb. 8, 1984

Related U.S. Application Data

[63] Continuation-in-part of Ser. No. 351,581, Mar. 1, 1982, abandoned, which is a continuation-in-part of Ser. No. 240,245, Mar. 3, 1981, abandoned.

[51] Int. Cl.[3] ..... F22B 1/00

[52] U.S. Cl. ..... 122/4 D; 122/6 A; 110/245

[58] Field of Search ..... 122/4 D, 6 A; 110/245, 110/347

[56] References Cited

U.S. PATENT DOCUMENTS

| | | | |
|---|---|---|---|
| 2,940,734 | 6/1960 | Harvey . | |
| 3,454,383 | 7/1969 | Pirsh et al. . | |
| 3,868,927 | 3/1975 | Losel et al. | 122/6 A |
| 3,910,255 | 10/1975 | Sharer . | |
| 4,103,646 | 8/1978 | Yerushalmi et al. | 122/4 D |
| 4,150,632 | 4/1979 | Matthews . | |
| 4,183,330 | 1/1980 | Bryers . | |
| 4,184,455 | 1/1980 | Talmud et al. | 122/4 D |
| 4,198,930 | 4/1980 | Pratt . | |

OTHER PUBLICATIONS

Chemical Engineering, Jun. 19, 1978, p. 100.

M. E. Boilers, Ltd., Peterborough, England, 7/14/80.

*Primary Examiner*—Henry C. Yuen

*Attorney, Agent, or Firm*—Fitch, Even, Tabin & Flannery

[57] ABSTRACT

A combustion boiler is described for use with low quality feedwater. A combusting fluidized bed is circulated through a substantially vertical elongated combustion chamber in an upward path from the lower end of the combustion chamber to the upper end. A single layer of a tubular fluid conduit surrounds the outer periphery of the combustion chamber. The configuration is such that an ascending helical flow path is provided for fluid passing therethrough. This configuration is designed to minimize solids decomposition leading to the tube burnout.

6 Claims, 6 Drawing Figures

FLUIDIZED BED COMBUSTION BOILER

This application is a continuation-in-part of application Ser. No. 351,581, filed Mar. 1, 1982, abandoned, which is a continuation-in-part of application Ser. No. 240,245, filed Mar. 3, 1981, now abandoned.

This invention relates generally to heat exchangers and, more particularly, to an improved combustion boiler for use with feedwater having a high dissolved solids content.

One application of combustion boilers is in connection with enhanced oil recovery systems. A steam and water mixture from the boiler is injected into oil-bearing strata to displace the oil. Since the feedwater available to the boiler at oil fields is normally of poor quality with a very high proportion of total dissolved solids, boilers for such applications generally employ a single tube circuit throughout the unit. Moreover, the steam quality at the boiler outlet is usually limited to not greater than 80% steam. By using this level of residual water at the outlet, together with employing a high fluid velocity in the tube circuit, salts and other dissolved solids are kept in solution to prevent deposition in the boiler tubes.

Typical boilers utilized for enhanced oil recovery applications are oil burning and utilize a horizontal combustion chamber. The chamber is cooled with tubes or pipes arranged in a horizontal serpentine configuration around the combustion chamber. Although meeting with some limited success, a problem exists in such designs in that the steam and water mixture in the tubes may be subjected to large variation in heat fluxes at different points in the tube circuit. If a high heat flux coincides with a region of the circuit containing relatively high quality steam, overheating may result in tube failure.

It is an object of the invention to provide an improved boiler construction that allows utilization of water containing a very high proportion of total dissolved solids as the heat transfer fluid.

Another object of the invention is to provide an improved boiler construction particularly suited for use in connection with enhanced oil recovery systems.

Another object of the invention is to provide an improved boiler that allows the utilization of water containing a very high proportion of total dissolved solids as the heat transfer fluid and which minimizes the possibility of tube failure while at the same time maximizing the heat transfer efficiency.

Other objects of the invention will become apparent to those skilled in the art from the following description, taken in connection with the accompanying drawings wherein.

Very generally, the combustion boiler 10 of the invention comprises a substantially vertical elongated combustion chamber 11. Circulation means 13 are provided for circulating a combusting fluidized bed upwardly through the combustion chamber from the lower end thereof to the upper end thereof. Tube means 15 are arranged in a single layer around the outer periphery of the combustion chamber. The tube means are of a configuration to provide an ascending helical flow path for fluid passing therethrough.

Figure 1:
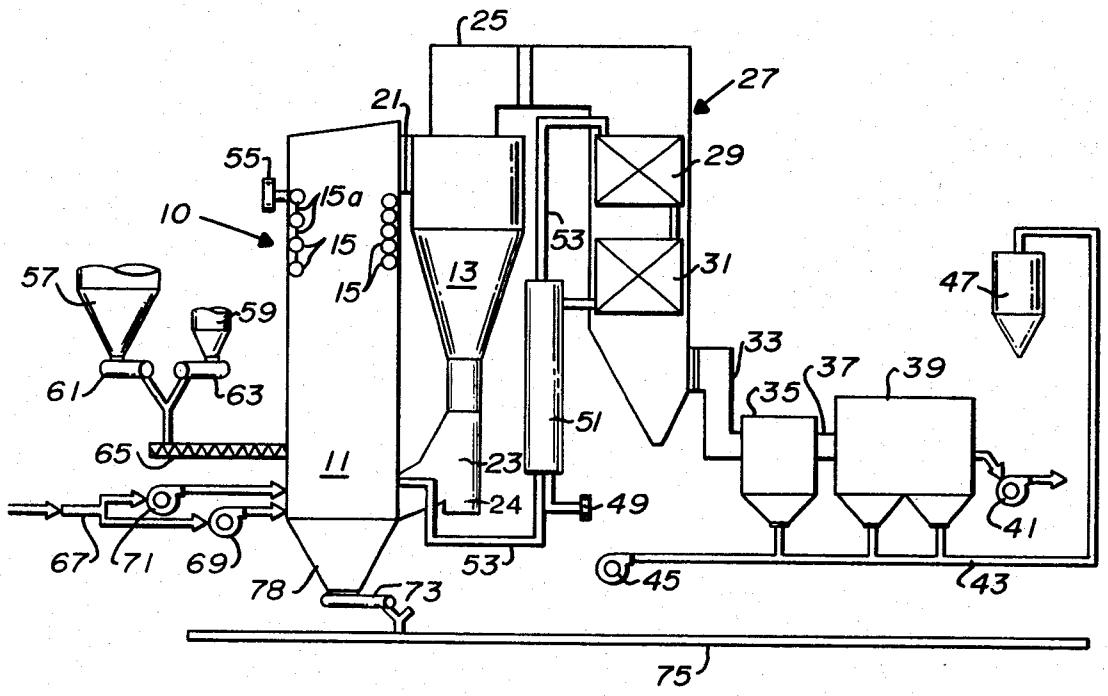
FIG. 1 is a schematic view of a boiler system employing the boiler of the invention.

Referring now in greater detail to the drawings, in FIG. 1 the overall schematic of the boiler system is shown. The boiler 10 of the invention employs a fluidized for high heat transfer efficiency. Circulating fluidized bed combustion boilers are able to utilize a wide variety of fuel and fuel sizes. Combustion efficiencies of 95–98% are common with inherent low generation of nitrous oxides and retention of the order of 95% of sulphur in the fuel as part of the solid ash discharge. Accordingly, significant benefits from an air pollution standpoint accrue.

The combustion fluidized bed is circulated vertically from the lower end of the combustion chamber 11 to the upper end 19 thereof and is removed through a duct 21 to a hot cyclone collector 13. The cyclone collector may be, for example, a 10 foot diameter cyclone into which the hot flue gas enters at a temperature of typically 1600° F. with entrained ash, limestone and unburned solid fuel. The solids are separated from the hot flue gas and are gravity fed to a lower chamber 23 from where they are returned to the combustion chamber by means of a suitable loop seal system 24, not shown in the remaining FIGURES. As is known to those of skill in the circulating fluidized bed art, a loop seal operates in a manner similar to that of a sink trap to prevent backflow from the combustion chamber to the lower chamber 23. The presence of a loop seal is desirable in many applications of the system, but is not a necessary part of the present invention.

The hot flue gas which exits the hot cyclone collector 13 continues through an overhead duct 25 to an economizer 27. In the economizer, the hot flue gas transfers its heat to the feedwater.

After leaving the steam generator 27, the flue gas is transferred through a duct 33 to a centrifugal type dust collector 35. The collector 35 may be of any suitable design to remove large particles from the flue gas. A duct 37 then passes the flue gas to a bag house type dust collector 39 of a suitable design known in the art for removal of fine particles in accordance with published requirements of the Environmental Protection Agency. The flue gas is then discharged to the stack, not shown, by means of an induced draft fan 41. Ash removal from the dust collectors 35 and 39 is through a duct 43 and the ash is entrained by a fly ash blower 45 to be deposited in a fly ash storage silo 47.

The water-steam path begins at a feedwater inlet 49 from where it circulates upwardly through a counterflow heat exchanger 51 and from there into the feedwater preheater section 31. From there the feedwater circulates through the final feedwater section 29 and then back through the tubing 53 and the counterflow heat exchanger 51 to the main combustion boiler 10 where the water is turned to steam at about 80% dryness. Steam then leaving the combustion boiler at the outlet 55 is utilized for enhanced oil recovery.

Fuel for the fluidized bed in the combustion boiler 10 is provided from a coal hopper 57 and a limestone hopper 59 through gravimetric feeders 61 and 63, respectively, to a screw type conveyor 65. The conveyor feeds the coal and limestone into the combustion boiler at the same point that the hot solids are returned from the hot cyclone collector 13. Air for combustion and entrainment of solids to provide the fluidized bed is provided from an air inlet 67 by means of a primary air fan 69 and a secondary air fan 71. Bottom ash is removed through a conduit 73 to a suitable removal conveyor 75.

Figure 2:
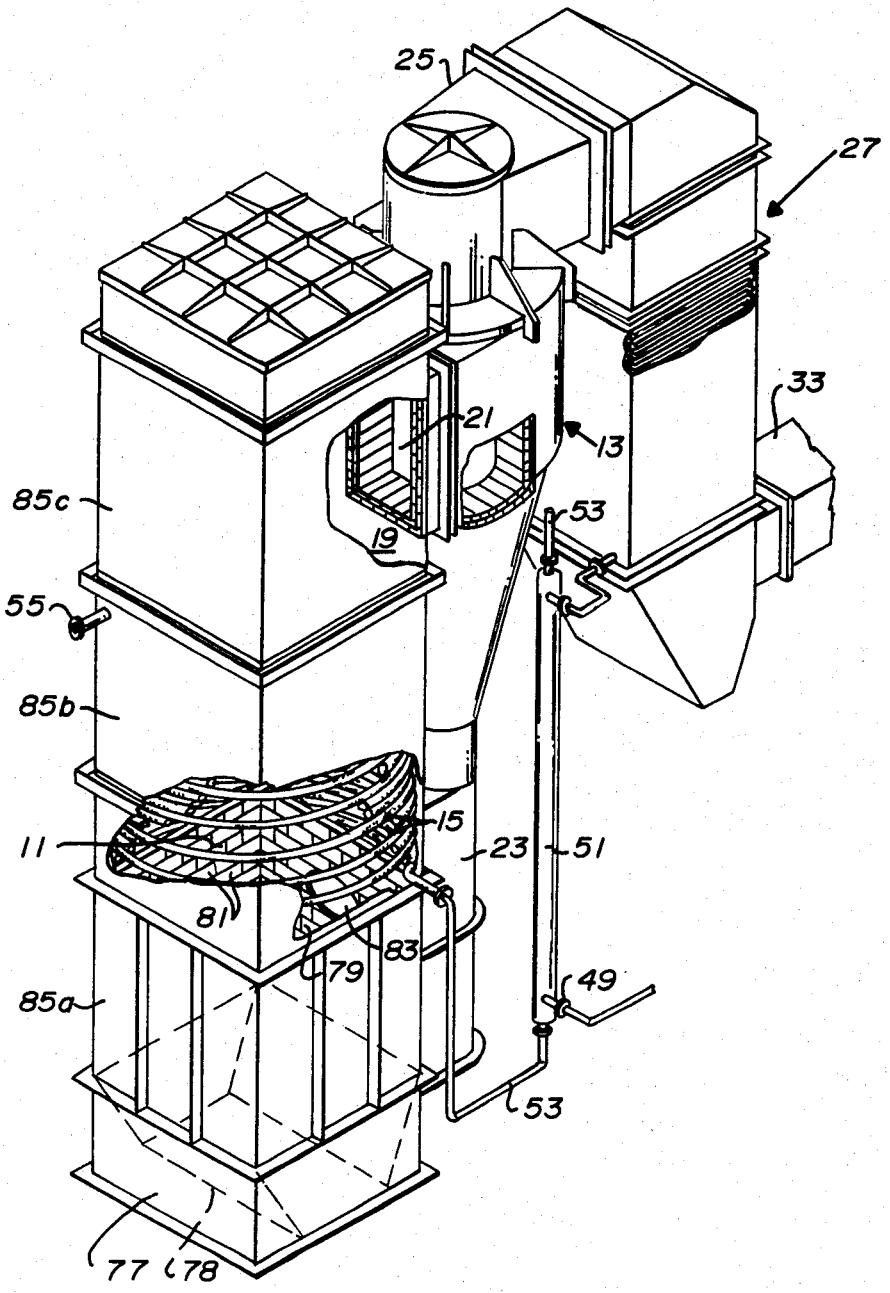
FIG. 2 is a schematic perspective view, with parts broken away of a portion of the system of FIG. 1.

Referring now more particularly to FIG. 2, the specific details of the construction of the combustion boiler 10 may be more easily seen. The lower end of the combustion boiler 10 is provided with an ash removal chamber 77 which encloses a hopper 78 which communicates with the ash removal duct 73 (FIG. 1) for bottom ash removal from the combustion boiler 10. Above the lower ash chamber 77 is a refractory chamber 79 which is lined with a wall of refractory bricks 81 or other suitable material for withstanding high temperature combustion materials. Recirculated solids enter the lower refractory chamber 79 through a duct 83 which communicates with the collector 23.

The combustion chamber 10 is provided with an outer wall 85*a–c* (FIG. 2) which encloses, respectively, the refractory chamber 79, the combustion chamber 11 and tube means 15, and the upper end 19. The fluidized bed, which is made up of circulating coal or other solid fuels and limestone replenished from the screw conveyor 65 (FIG. 1), enters the lower refractory chamber 79 at a point not illustrated in FIG. 2 but level with the duct 83. These returned solids entering the lower refractory chamber 83 are entrained in the circulating gases and flow upwardly through the combustion chamber 11. As a natural consequence of the combustion pattern, the heat transfer coefficients to the steam tubing are higher at the lower end of the combustion chamber 11 than at the higher end of the combustion chamber 11.

In operation of the combustion boiler, start-up is accomplished by utilizing an oil or gas fired start-up heating system not shown, as is known in the fluidized bed art. Once the bed material is heated to a sufficiently high temperature, for example 1000° F., the feeding of coal and limestone is begun and the unit is brought up to full load using the solid fuel. The oil and gas firing for start-up purposes is then terminated once stable combustion of the coal is achieved at a suitable flow rate, for example 33% of full flow rate. Typically, fuel feed is controlled by the gravimetric feeders 61 and 63 in FIG. 1 as desired. The ratio of limestone to coal may be maintained over all load ranges as desired in response to changes in the content of sulphur-oxygen compounds in the exhaust gases.

As shown in FIG. 2, the combustion chamber 11 is of generally square cross-section. A circular cross-section, however, is also practical. The flow of water-steam mixture through the combustion chamber for heat exchange with the fluidized bed is accomplished by the tube means 15. The tube means comprise one or more tubular conduits arranged in a single layer and having a helical configuration so that the water-steam mixture passes in a helical path around the combustion chamber 11 and upwardly toward the upper end thereof. The tube means 15 form an envelope surrounding the outer periphery of the combustion chamber 11 and form a wall by being tangentially engaged throughout substantially the entire length of the tubes, as shown in FIG. 2 and also in the right-hand schematicized broken out portion in FIG. 1. Alternatively, the tubes may be joined by webs 15*a* as shown in the left-hand schamaticized broken out portion of FIG. 1. In either case, the tube means form a wall representing a water-cooled envelope surrounding the exterior or periphery of the combustion chamber.

Figure 3:
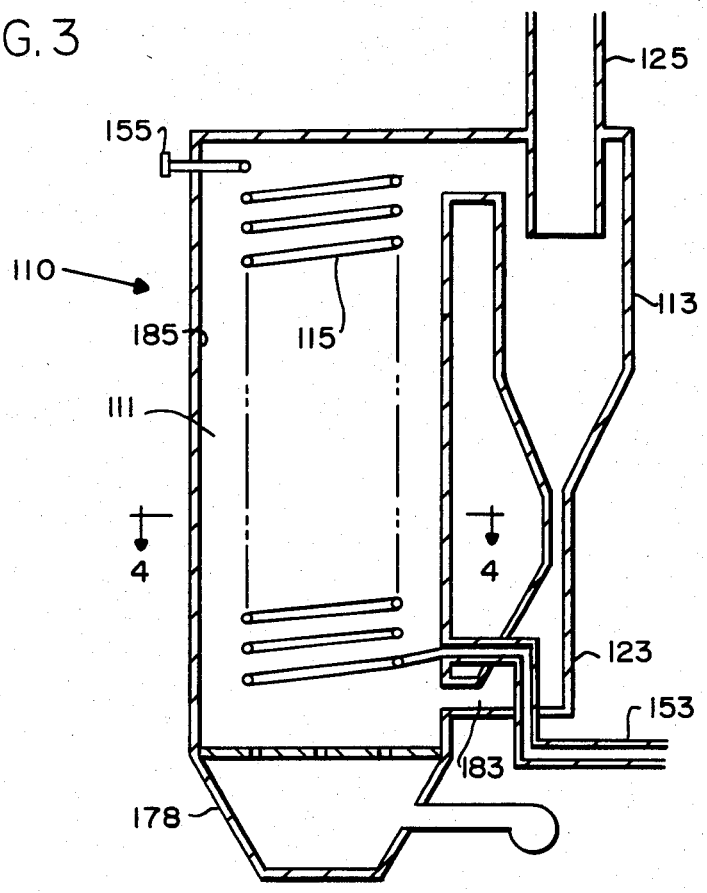
FIG. 3 is a schematic view of a portion of a further embodiment of the invention.
Figure 4:
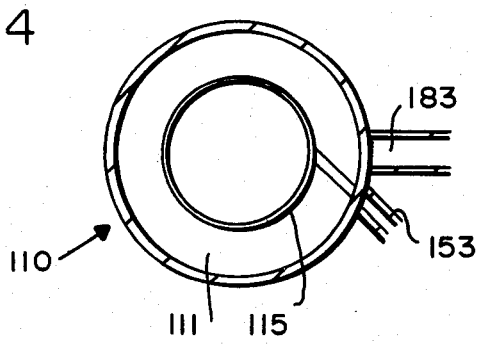
FIG. 4 is a sectional view taken along the line 4—4 of FIG. 3.

In FIGS. 3 and 4, a combustion boiler comprising a further embodiment of the invention is shown. Portions of the boiler having similar function to those portions of the boiler of the embodiment of FIGS. 1 and 2 are given identical reference numbers preceded by a 1. In the embodiment of FIGS. 3 and 4, the tube means 115 are arranged at a location displaced from the wall 85 of the combustion boiler 10. Moreover, the convolutions of the tube means are spaced axially from each other to permit the combustion gases with entrained solids to flow along the outside as well as the inside of the helical tube coil. This provides a high heat transfer efficiency.

In order to avoid disturbance of the flow of material in the lower end of the combustion chamber 111, the vertical distance or distance parallel with the axis of the helix between adjacent convolutions may be arranged to be larger in the lower part of the helix than in the upper part. In this way, more heat will be absorbed by the fluid flowing through the conduit in the upper part of the combustion chamber. Thus, the distance between the convolutions of the tube means 115 may be selected to precisely match the heat distribution in the flowing gases and entrained solids within the combustion boiler.

Figure 5:
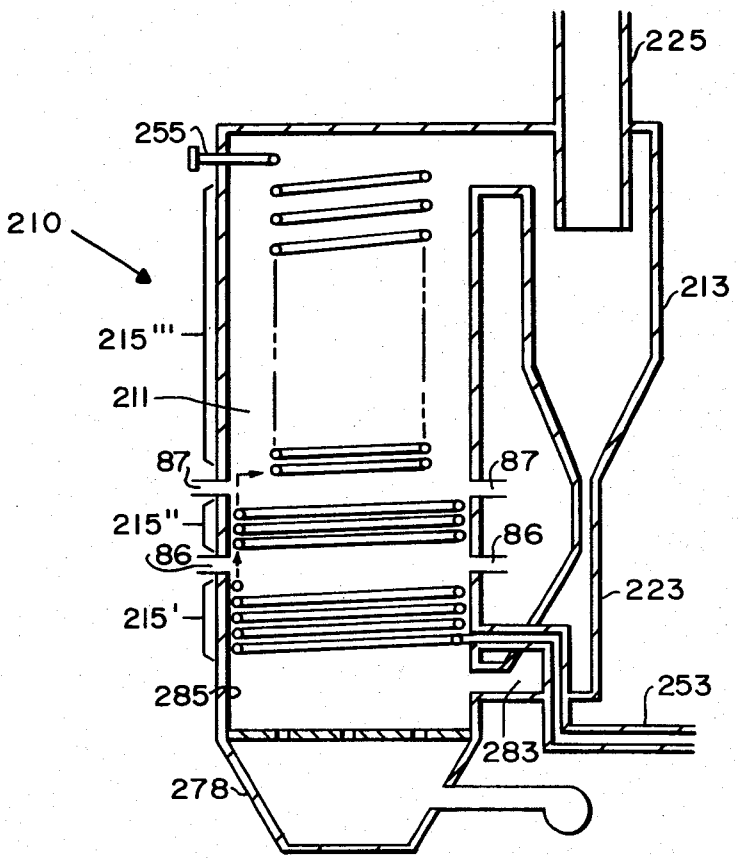

In FIG. 5, a still further embodiment of the invention is shown. Those elements of FIG. 5 which are similar in function to corresponding elements of FIG. 1 have been given identical reference numerals preceded by a 2. In the embodiment of FIG. 5, the tube means 215 are arranged in three groups, 215', 215'', and 215'''. The tubes of the group 215' and 215'' in the lower part of the combustion chamber are arranged around its outer periphery in order to offer less disturbance to the flow of the gases and entrained solids. The conduit of the third group 215''' is disposed at a location displaced from the wall of the combustion chamber so that the gases with entrained solids may flow along the outside as well as the inside of the tube coils in this region. The groups 215' and 215'' are separated by a distance sufficient to allow for the injection of secondary air through a duct 86. Similarly, the group 215''' is separated from the group 215'' by a space sufficient to permit insertion of secondary air through a pair of ducts 87.

Figure 6:
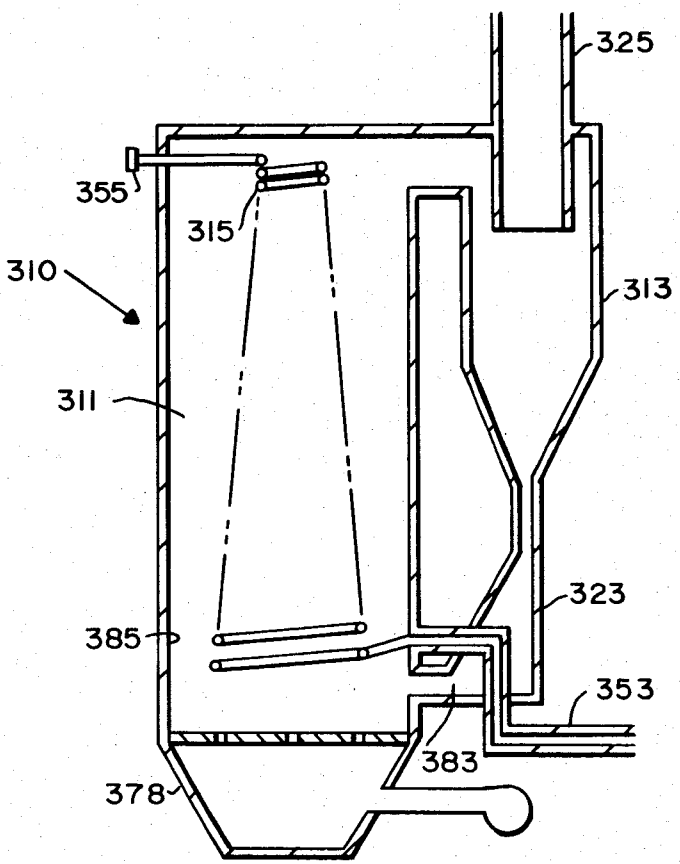
FIGS. 5 and 6 are schematic views of portions of two different further embodiments of the invention.

In FIG. 6, a further embodiment of the invention is shown in which elements having functions similar to those of the corresponding elements of FIG. 1 are given identical reference numerals preceded by a 3. In the embodiment of FIG. 6, the tube means 315 are of decreasing diameter as the height of the helix increases. Accordingly, the envelope of the helix is in a generally frustoconical shape. This provides for a flow path for the gases and entrained solids to fully surround the tubes, passing between adjacent convolutions as well as on the inside and the outside of the helically arranged tube means. In the tube means 15, 115, etc., the flow of the steam-water mixture is helically upward. Thus, at the relatively higher heat fluxes toward the lower end of the combustion chamber 11 the steam quality of the circulating water-steam mixture is lower. Toward the higher end of the combustion chamber, where the heat transfer coefficients to the tube means are lower in the fluidized bed, the steam quality in the water-steam mixture flowing through the tube means is higher. This configuration in a single pass flow mitigates against possible overheating of the steam-water to produce deposition of the dissolved solids on the tube and consequent tube failure. Typical exiting steam quality of the boiler is limited to about 80% and this, together with the maintenance of a relatively high flow velocity in the tube means, is adequate to keep solids in solution and prevent deposition inside the tubes.

More particularly, typical steam-water flow rates in the boiler of the invention may vary between 700 and 3,000 kilograms per second-square meter. Ths boiler may be constructed with tube dimensions in the range of about 12.5 millimeters to about 100 millimeters diameter. The larger diameter tubes are normally used in the single pass design on the water side. Smaller diameter tubes are normally used for the multipass designs. For a twin pass boiler of 50 million BTU per hour capacity, the preferred diameter range is 40–65 millimeters inner diameter with a superficial velocity of between 2 meters per second and 20 meters per second. The gas temperature at typical design conditions is 850°–950° C. plus or minus 100° C. in most cases. Where sulphur is present, a lower design temperature may be used.

It may be seen, therefore, that the invention provides an improved combustion boiler which employs a fluidized bed in combination with a vertical bed flow and upward helical circulation of coolant. Despite high dissolved solids content in the water-steam mixture, efficient heating with minimal internal deposits result. Moreover, the invention minimizes conditions which lead to tube failure. This, in combination with the fluidized bed, leads to high heating efficiency despite the once through pass conditions required under such circumstances.

Various modifications of the invention in addition to those shown and described herein will become apparent to those skilled in the art from the foregoing description and accompanying drawings. Such modifications are intended to fall within the scope of the appended claims.

What is claimed is:

1. A circulating fluidized bed combustion boiler for producing steam from water containing a substantial proportion of dissolved solids, comprising, a substantially vertical elongated combustion chamber, circulation means for circulating a combusting fluidized bed upwardly through said combustion chamber from the lower end thereof to the upper end thereof, said circulating means including means for withdrawing gasses and entrained solids from the upper end of said combustion chamber and for separating solids from said fluidized bed after passage through said combustion chamber and for storing said solids for return to said combustion chamber at the lower end thereof, and tube means arranged in a single layer around the outer periphery of said combustion chamber, said tube means comprising at least one coiled tube with the convolutions thereof being joined by a web throughout substantially the entire length of said tube, said means including inlet means positioned toward the lower end of said combustion chamber and including outlet means positioned toward the upper end of said combustion chamber and being of a configuration to provide an ascending helical flow path for fluid passing therethrough and such that the region of higher steam quality in said tube means coincides with the region of lowest heat transfer coefficients, and means for establishing a flow of fluid in said tube means to result in a steam quality and flow velocity sufficient to prevent deposition of solids on said tube means.

2. A combustion boiler according to claim 1 wherein said tube means define a wall enclosing said combustion chamber.

3. A combustion boiler according to claim 1 wherein said combustion chamber is of substantially circular cross-section.

4. A combustion boiler according to claim 1 wherein said combustion chamber is of substantially square cross-section.

5. A combustion boiler according to claim 1 including inlet means for said tube means positioned toward the lower end of said combustion chamber and including outlet means positioned toward the upper end of said combustion chamber.

6. A combustion boiler according to claim 1 wherein said circulating means comprise means for withdrawing gases and entrained solids from the top of said combustion chamber and for returning solids to the lower end thereof.

* * * * *